US008581789B2

(12) United States Patent
Desclos et al.

(10) Patent No.: US 8,581,789 B2
(45) Date of Patent: Nov. 12, 2013

(54) ACTIVE SELF-RECONFIGURABLE MULTIMODE ANTENNA SYSTEM

(71) Applicant: Ethertronics, Inc., San Diego, CA (US)

(72) Inventors: Laurent Desclos, San Diego, CA (US); Jeffrey Shamblin, San Marcos, CA (US); Barry Matsumori, La Jolla, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 13/674,112

(22) Filed: Nov. 12, 2012

(65) Prior Publication Data

US 2013/0135171 A1 May 30, 2013

Related U.S. Application Data

(63) Continuation-in-part of application No. 13/029,564, filed on Feb. 17, 2011, now Pat. No. 8,362,962, which is a continuation of application No. 12/043,090, filed on Mar. 5, 2008, now Pat. No. 7,911,402, application No. 13/674,112, which is a continuation-in-part of application No. 13/289,901, filed on Nov. 4, 2011, which is a continuation of application No. 12/894,052, filed on Sep. 29, 2010, now Pat. No. 8,077,116, which is a continuation of application No. 11/841,207, filed on Aug. 20, 2007, now Pat. No. 7,830,320.

(51) Int. Cl.
*H01Q 1/24* (2006.01)

(52) U.S. Cl.
USPC ..... 343/702; 343/745; 343/815; 343/876

(58) Field of Classification Search
USPC ..... 343/702, 745, 815, 876
See application file for complete search history.

(56) References Cited

U.S. PATENT DOCUMENTS

| | | | | |
|---|---|---|---|---|
| 6,862,432 | B1 * | 3/2005 | Kim | 455/80 |
| 6,954,180 | B1 * | 10/2005 | Braun et al. | 343/702 |
| 7,369,828 | B2 * | 5/2008 | Shamsaifar | 455/193.1 |
| 7,969,381 | B2 * | 6/2011 | Kanazawa et al. | 343/876 |
| 2009/0295648 | A1 * | 12/2009 | Dorsey et al. | 343/702 |

* cited by examiner

*Primary Examiner* — Tho G Phan
(74) *Attorney, Agent, or Firm* — Coastal Patent Law Group, P.C.; Joshua S. Shoonover

(57) ABSTRACT

A self-reconfigurable multimode antenna system where loading conditions of sensors are analyzed and used to generate control signals to dynamically reconfigure an antenna for improved performance. One or multiple sensors can be coupled to the antenna to dynamically change the radiating structure. One or multiple sensors can be coupled to the input or matching section of the antenna to improve or alter the impedance match of the antenna. An algorithm to relate loading effects of sensors to dynamically adjust the antenna is described.

15 Claims, 17 Drawing Sheets

- EM sensors detect changes to environment
- EM sensor values compared to data base of loading scenarios
- Antenna tuning inputs generated in CPU to optimize antenna

- Active components connecting EM sensor elements
- EM Sensor provides information to CPU
- Active antenna tuned based on sensor inputs EM sensor embedded in cover
- Active components connecting EM sensor elements
- EM Sensor provides information to CPU
- Active antenna tuned based on sensor inputs EM sensors embedded in cover can be connected to form larger sensors to vary the resolution in the sensing environment

- EM sensors detect changes to environment
- EM sensor values compared to data base of loading scenarios
- Antenna tuning inputs generated in CPU to optimize antenna Size and form factor of the EM sensor can be varied to adjust reactance properties of the sensor to alter the impedance match of the antenna Size and form factor of the EM sensor can be varied to enhance the radiator performance Finger-shaped sensors designed to determine grip and positioning of user's hand Sensors designed into decorative features or Logos Sensors designed into decorative features or Logos Sensors designed into decorative features or Logos
Loading of Logo sensor modifies impedance match of antenna Sensors designed into decorative features or Logos
Loading of Logo sensor modifies radiating efficiency of antenna EM sensor embedded in cover
- Active components connecting EM sensor elements
- CPU embedded in active antenna
- Active antenna tuned based on sensor inputs

- Hand or body loading of device can be sensed and comparison of antenna performance between feeds can be conducted
- Best antenna feed selected for loading environment

- Multi-layer EM sensor can be implemented to increase resolution or accuracy of environmental measurement
- Parameters such as separation distance, D1, or capacitance, C1, can be used to track environmental loading

- Examples of IMD resonant structures for use as EM sensors
- Changes in resonant frequency can be monitored to determine Environmental changes

ACTIVE SELF-RECONFIGURABLE MULTIMODE ANTENNA SYSTEM

CROSS-REFERENCE TO RELATED APPLICATIONS

This application is a CIP of U.S. Ser. No. 13/029,564, filed Feb. 17, 2011, and titled "ANTENNA AND METHOD FOR STEERING ANTENNA BEAM DIRECTION", which is a CON of U.S. Ser. No. 12/043,090, filed Mar. 5, 2008, titled "ANTENNA AND METHOD FOR STEERING ANTENNA BEAM DIRECTION", now issued as U.S. Pat. No. 7,911,402; and a CIP of U.S. Ser. No. 13/289,901, filed Nov. 4, 2011, titled "ANTENNA WITH ACTIVE ELEMENTS", which is a CON of U.S. Ser. No. 12/894,052, filed Sep. 29, 2010, titled "ANTENNA WITH ACTIVE ELEMENTS", now U.S. Pat. No. 8,077,116, which is a CON of Ser. No. 11/841,207, filed Aug. 20, 2007, titled "ANTENNA WITH ACTIVE ELEMENTS", now U.S. Pat. No. 7,830,320;

the contents of each of which are hereby incorporated by reference.

BACKGROUND OF THE INVENTION

1. Field of the Invention

The present invention relates to antenna systems for mobile wireless devices and more particularly to implementation of a sensor assembly, active antenna, algorithm, and control system for improved connectivity in a communication link.

2. Description of the Related Art

As new generations of handsets and other wireless communication devices become smaller and embedded with increased applications, new antenna designs are required to address inherent limitations of these devices and to enable new capabilities. With classical antenna structures, a certain physical volume is required to produce a resonant antenna structure at a particular frequency and with a particular bandwidth. In multi-band applications, more than one such resonant antenna structure may be required. But effective implementation of such complex antenna arrays may be prohibitive due to size constraints associated with mobile devices.

SUMMARY OF THE INVENTION

A self-reconfigurable multimode antenna system where loading conditions of sensors are analyzed and used to generate control signals to dynamically reconfigure an antenna for improved performance. One or multiple sensors can be coupled to the antenna to dynamically change the radiating structure. One or multiple sensors can be coupled to the input or matching section of the antenna to improve or alter the impedance match of the antenna. In another aspect, an algorithm is provided to relate loading effects of sensors and dynamically adjust the antenna for operation at a selected mode. Other features and embodiments are described in the detailed description.

BRIEF DESCRIPTION OF THE DRAWINGS

The invention can be further understood upon review of the following detailed description in conjunction with the appended drawings, wherein.

DETAILED DESCRIPTION OF THE PREFERRED EMBODIMENTS

Figure 1:
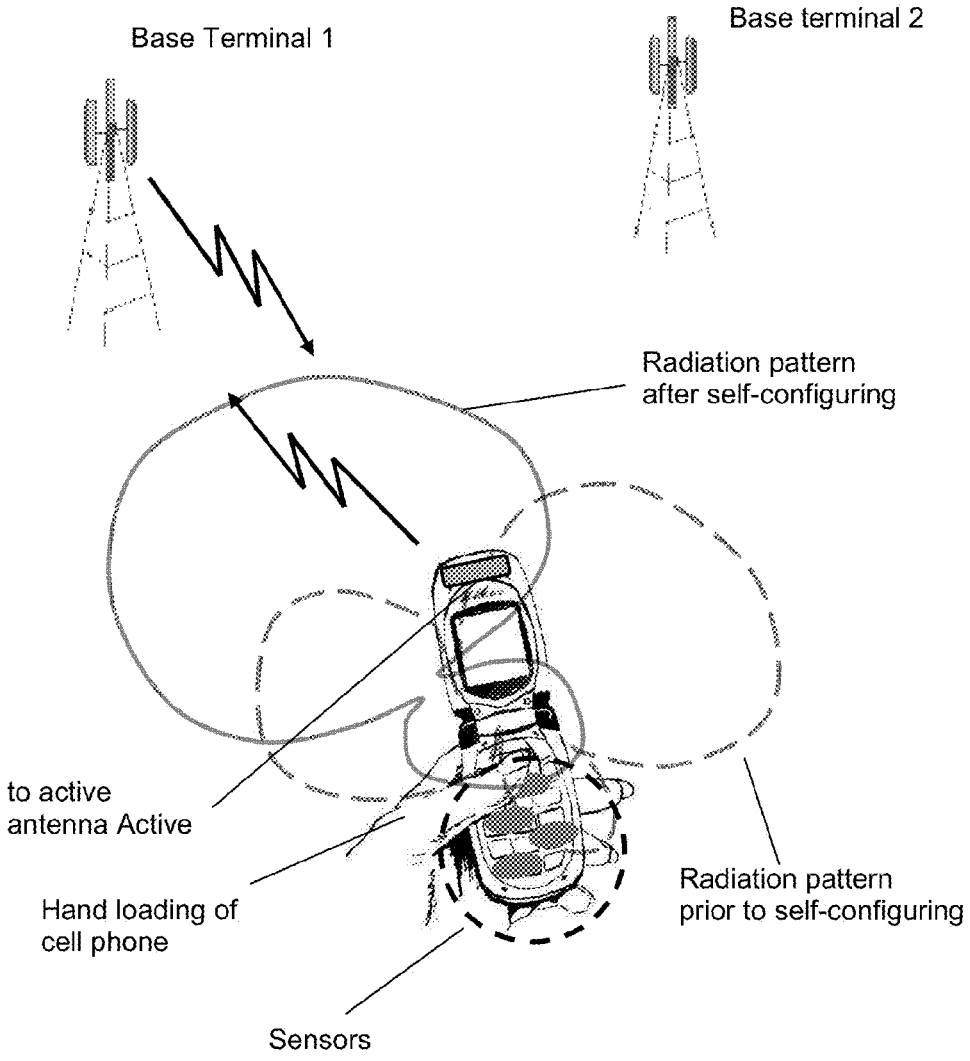
FIG. 1 illustrates a wireless communication device connected to a wireless network, the device comprises an active modal antenna and a plurality of proximity sensors disposed about the device, a mode of the antenna is configured based on information from the sensors.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

Commonly owned, U.S. Pat. No. 7,911,402, titled "ANTENNA AND METHOD FOR STEERING ANTENNA BEAM DIRECTION", and U.S. Pat. No. 7,830,320, titled "ANTENNA WITH ACTIVE ELEMENTS", disclose antenna systems capable of beam steering, band switching, active matching, and other active tunable characteristics; the contents of each of which are hereby incorporated by reference. These antennas utilize a radiating element and one or more parasitic elements coupled to active elements in a manner for enabling switching, variable reactance, and other tuning of the antenna components. The resulting structure is an active tunable antenna capable of operating in multiple modes, otherwise termed an "active modal antenna" or "modal antenna". The referenced patents disclose active modal antennas and thus details of these structures will not be discussed in detail herein.

An "active modal antenna" as referred to herein includes an antenna capable of selective operation about a plurality of modes, wherein each of said plurality of modes generates a distinct antenna radiation pattern resulting from the first active modal antenna. In this regard, the active modal antenna can be reconfigured as necessary to provide an optimal radiation pattern. This is accomplished by one or more of: band-switching, beam steering, and active impedance matching as environmental effects detune the antenna. In representative examples, an active modal antenna comprises a radiating structure disposed above a circuit board and forming an antenna volume therebetween; a parasitic element positioned adjacent to the radiating structure; and an active element coupled to the parasitic element; wherein the active element is configured for one or more of: adjusting a reactance of the parasitic element, or shorting the parasitic element to ground.

As referenced herein, an "active element" may comprise at least one of: a voltage controlled tunable capacitor, voltage controlled tunable phase shifter, field-effect transistor (FET), tunable inductor, switch, or any combination thereof.

In one embodiment, an antenna system adapted for integration with a wireless communication device is provided, the antenna system comprises: an active modal antenna capable of selective operation about a plurality of modes, wherein each of said plurality of modes generates a distinct antenna radiation pattern resulting from the first active modal antenna; and a processor coupled to the active modal antenna. The processor is adapted to be further coupled to a plurality of sensors each disposed about the wireless communication device, wherein the plurality of sensors are configured to sense an instantaneous use case from a plurality of possible use cases of the device. The processor is configured to access a lookup table containing data relating each of the plurality of possible use cases with a corresponding antenna mode of the plurality of modes for achieving optimum antenna performance. In this regard, the antenna system is configured to determine the instantaneous use case of the device using the sensors, lookup the corresponding antenna mode for achieving optimum antenna performance with the device in the instantaneous use case, and configure the active modal antenna to function in the corresponding antenna mode.

Example use cases of the device may include: device held against head; device held in hand away from head; two hands on device; no hands on device; among others.

In one embodiment, the first active modal antenna comprises: a radiating structure disposed above a circuit board and forming an antenna volume therebetween; a parasitic element positioned adjacent to the radiating structure; and an active element coupled to the parasitic element; wherein said active element is configured for one or more of: adjusting a reactance of the parasitic element, or shorting the parasitic element to ground.

In one embodiment, the processor is a baseband processor residing within the wireless communication device. Alternatively, the processor can comprise an applications processor separate from the device baseband processor.

In various embodiments, the active modal antenna can be configured for one or more of: beam steering, band switching, and active impedance matching. Generally, a parasitic element is disposed adjacent to the antenna radiating element and outside of the antenna volume for providing beam steering function; a parasitic element is disposed adjacent to the antenna radiating element and positioned within the antenna volume to provide band-switching function; and the antenna comprises one or more active elements forming an active matching circuit adapted to vary a reactance of the antenna radiating element for providing active impedance matching.

In one embodiment, the sensors comprise capacitive proximity sensors. One or more of the sensors can be shaped and positioned about the wireless communication device to conform to fingers of a user when holding the device. One or more of the sensors can be configured in the shape of a logo.

In another embodiment, the sensors are disposed about a first substrate layer and a second substrate layer positioned above the first substrate layer for multi-layer sensing and providing increased resolution and accuracy in determining the instantaneous use case.

The sensors may comprise discrete sensor elements positioned about the wireless communication device. Alternatively, the sensors may comprise a continuous array of sensor elements positioned about the wireless communication device. Still further, the sensors may comprise a multi-layer continuous array of sensor elements positioned about the wireless communication device.

In one embodiment, one or more of the sensors may comprise an isolated magnetic dipole element. In this regard, the isolated magnetic dipole (IMD) element is influenced by coupling reactance from environmental loading. The change in reactance of the IMD element can be used to sense an instantaneous use case of the device.

In another embodiment, the antenna system can further comprising an active matching circuit coupled to the active modal antenna and the processor, the active matching circuit comprising one or more active elements and configured to vary a reactance of the antenna based on the instantaneous use case and the data stored within the lookup table.

In yet another embodiment, an antenna system adapted for integration with a wireless communication device is provided, the antenna system comprises: an active modal antenna capable of selective operation about a plurality of modes, wherein each of said plurality of modes generates a distinct antenna radiation pattern resulting from the first active modal antenna; a processor coupled to the active modal antenna; and an active matching circuit coupled to the active modal antenna and the processor, the active matching circuit adapted to vary a reactance of the antenna. The processor is adapted to be further coupled to a plurality of sensors disposed about the wireless communication device, wherein the plurality of sensors are each configured to sense an instantaneous use case from a plurality of possible use cases of the device. The processor is configured to access a lookup table containing data relating each of the plurality of possible use cases with a corresponding antenna mode of the plurality of modes for achieving optimum antenna performance. The antenna system is configured to determine the instantaneous use case of the device using the sensors, lookup the corresponding antenna mode for achieving optimum antenna performance with the device in the instantaneous use case, and configure the active modal antenna to function in the corresponding antenna mode. The antenna system is further configured to communicate control signals from the processor to the active matching circuit for dynamically matching the impedance of the antenna.

In certain other embodiments, an antenna system comprises: an active modal antenna; one or multiple sensors; and a processor and control circuit; the processor is programmed with an algorithm for enabling the control circuit to take inputs from one or multiple sensors and send commands to the active antenna to optimize the antenna based upon loading of the sensors. The parameters that can be optimized are the frequency response of the radiator, the impedance match, and the antenna radiation pattern.

One or multiple sensors may be attached or coupled to the antenna or matching circuit of the antenna. Loading of the sensors coupled to the antenna and processor allow for improvement or variation in the impedance properties of the antenna.

In certain embodiments, the sensors are attached or coupled to the antenna and function as an extension of the radiating element. Loading of the sensors provides a mechanism for improving the radiating properties of the antenna.

In certain other embodiments, the sensors are attached or coupled to the antenna and function as an extension of the radiating element and the matching circuit of the antenna.

Specific absorption rate (SAR) with regard to the antenna can be dynamically adjusted according to certain embodiments of the invention. A loading of the sensors is processed and commands are sent to the active antenna to modify the near-field radiating properties for modification of, and/or improvements of SAR. Data associated with the various use cases of the device and corresponding specific absorption rate requirements can be stored in the lookup table in a memory portion of the device.

As specified above, an algorithm is programmed into the device and configured to receive and analyze sensor loading data, and send control signals to active elements of the active modal antenna or active matching circuit to modify antenna tuning parameters. The algorithm processes signals from individual sensors to estimate a loading profile of the wireless device; a data base of previously measured or calculated loading values is accessed to make an estimation of the loading on the device or the local environment. Control signals are generated and sent to the active modal antenna. The control signals adjust active elements of the active modal antenna to optimize the antenna for the loading environment.

The sensors can incorporate a decorative feature embedded in or on the outer surface of an enclosure, where portions of the decorative feature are fabricated from the sensors. The sensors can be used to determine device loading or the condition of the local environment. One or more active elements of the antenna are tuned based upon the input from the sensors and data stored in the lookup table.

In various examples herein, the sensors may comprise one or more of the following: a conductive layer for use in conveying the loading attributes of objects or the environment; multiple conductors where the capacitance between conductors is monitored; an electromagnetic resonator formed by a two-dimensional or three-dimensional conductive structure shaped and dimensioned to form a resonant circuit wherein the resonant frequency of the resonator is monitored and utilized to determine changes in the environment; or an electromagnetic resonator formed by a two-dimensional or three-dimensional conductive structure shaped and dimensioned to form a resonant circuit and containing dielectric, ferrite, or magnetic materials or a combination of these materials wherein the resonant frequency of the resonator is monitored and utilized to determine changes in the environment.

However, it should be noted that the sensors may comprise any component or device that monitors changes to: inductive or capacitive properties in the vicinity of the component, infrared spectrum in the vicinity of the component, optical spectrum in the vicinity of the component, or acoustic spectrum in the vicinity of the component, wherein the component or components are used to determine changes to the environment or loading of the device, with this information used to optimize an antenna.

Now turning to the drawings, FIG. 1 illustrates a technique wherein sensors embedded in a wireless device are used to detect hand loading of the device. The active modal antenna contained within the wireless device is altered based upon the sensed loading to optimize the radiation pattern for the intended communication link.

Figure 2:
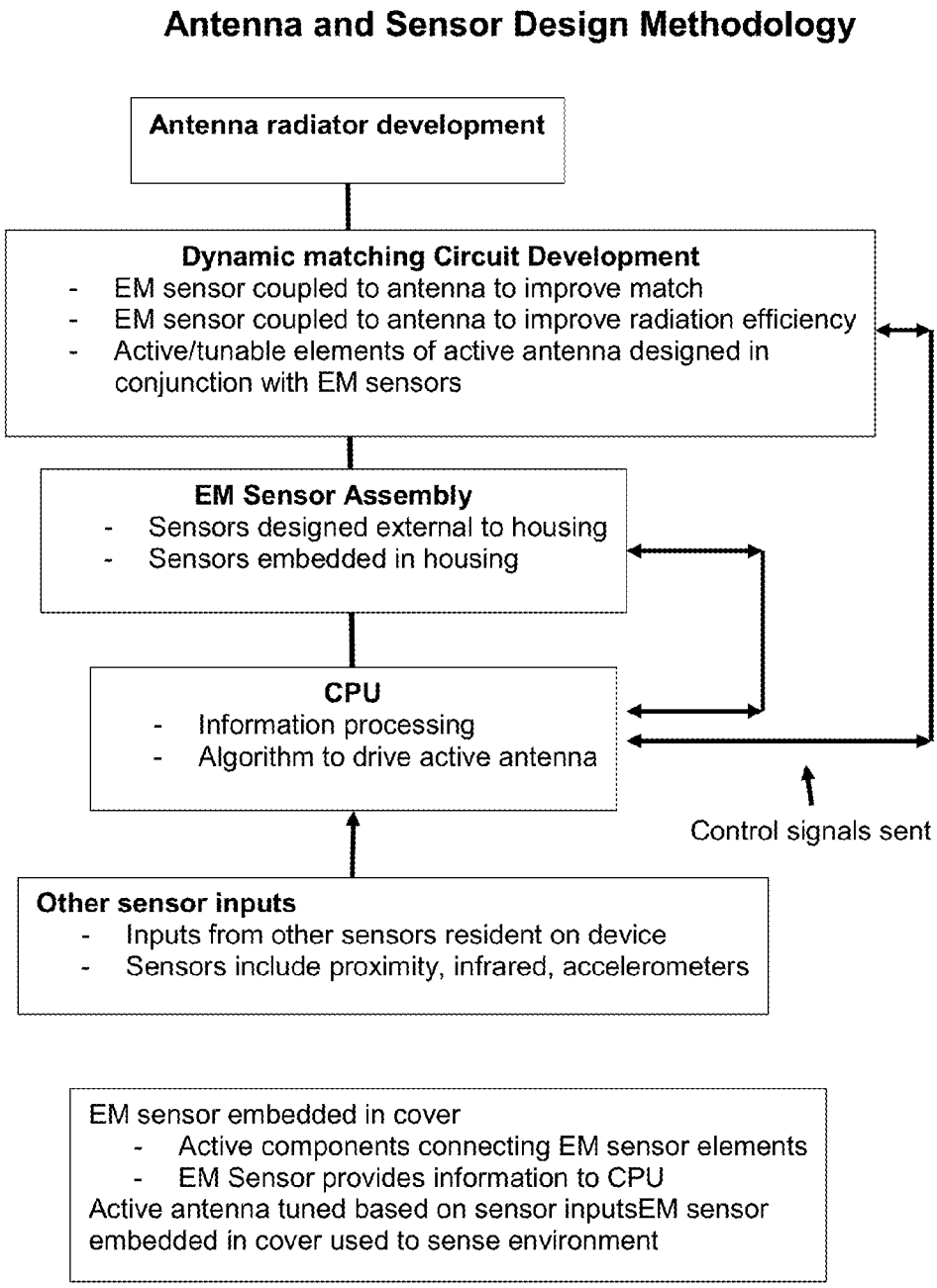
FIG. 2 illustrates an antenna and sensor design methodology.

FIG. 2 illustrates a block diagram describing a design methodology for implementing a sensor assembly and antenna combination. The sensor elements provide a measure of environmental change in the vicinity of the wireless device to the processor; the processor in turn, provides control signals to dynamically optimize the antenna.

Figure 3:
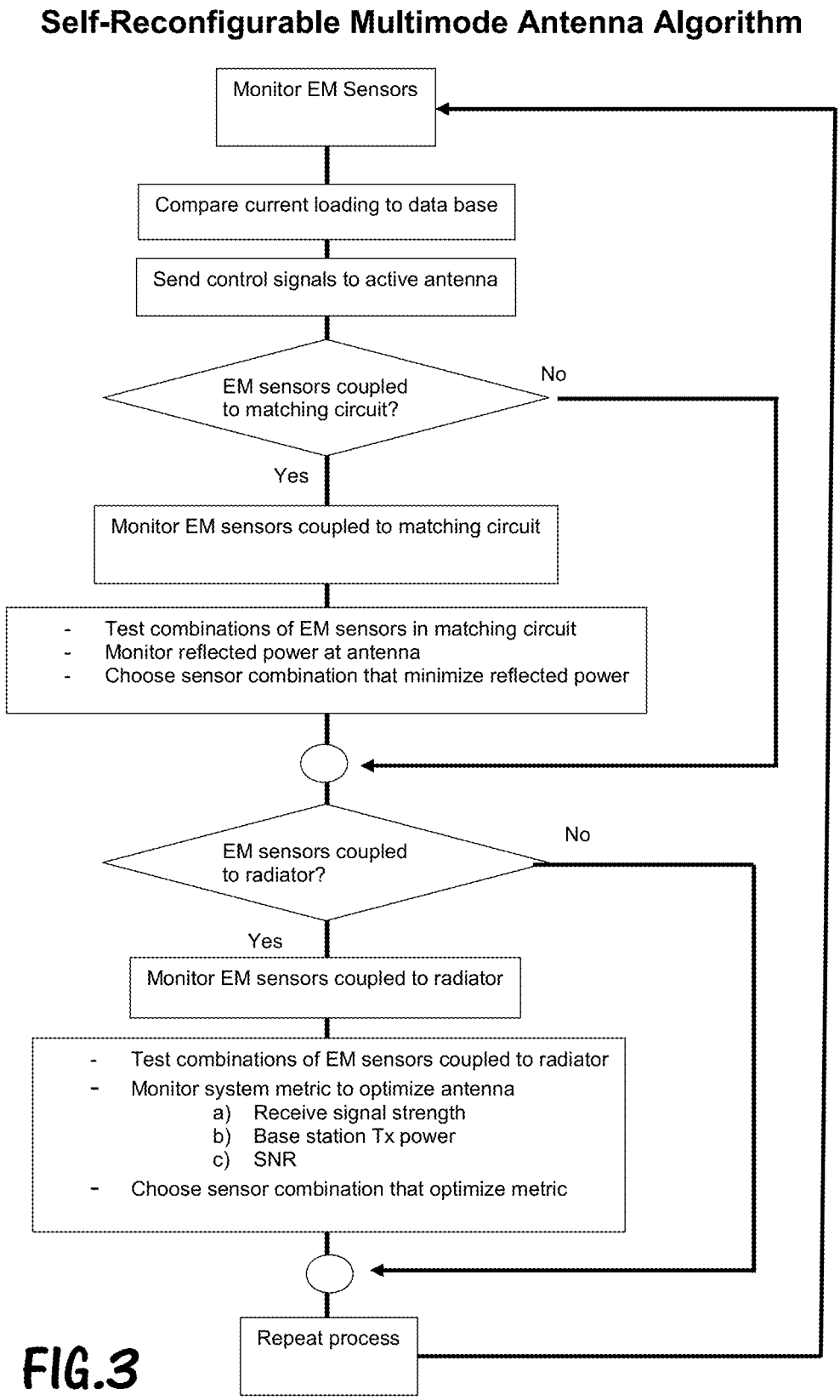
FIG. 3 illustrates a self-reconfigurable multimode antenna algorithm.

FIG. 3 describes an algorithm adapted to monitor inputs from Sensors and use this information to alter the tuning of a multimode antenna.

Figure 4:
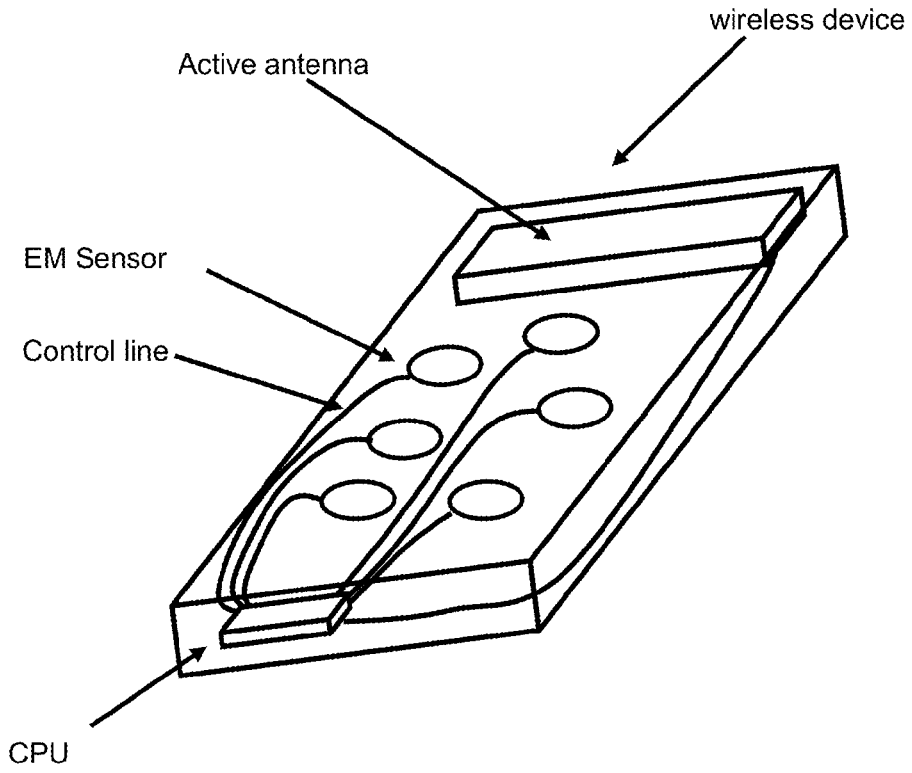
FIG. 4 illustrates a wireless communication device having an active modal antenna and a plurality of sensors each coupled to a processor.

FIG. 4 illustrates an example of an assembly of sensors embedded in the cover of a wireless device. Control lines connect the sensors to the processor, which in turn is connected to an active modal antenna. The processor processes signals from the sensors which provide an indication of the local environment; control signals are then sent to the antenna to optimize the antenna with a preferred mode for communication link performance.

Figure 5:
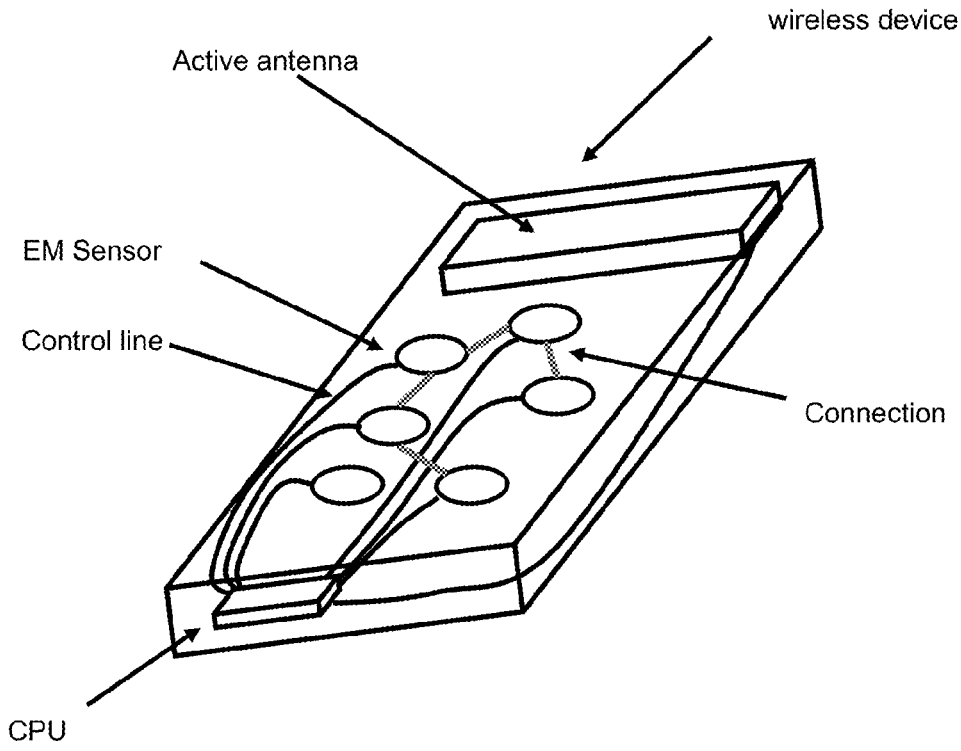
FIG. 5 illustrates a wireless communication device having an active modal antenna and a plurality of sensors each coupled to a processor; wherein the sensors are connected to form a large sensor arrangement.

FIG. 5 illustrates an example of an assembly of sensors embedded in the cover of a wireless device. Individual sensors can be connected to form larger sensors. Control lines connect the sensors to the processor, which in turn is connected to an antenna. The processor processes signals from the sensors which provide an indication of the local environment; control signals are then sent to the antenna to optimize the antenna for communication link performance.

Figure 6:
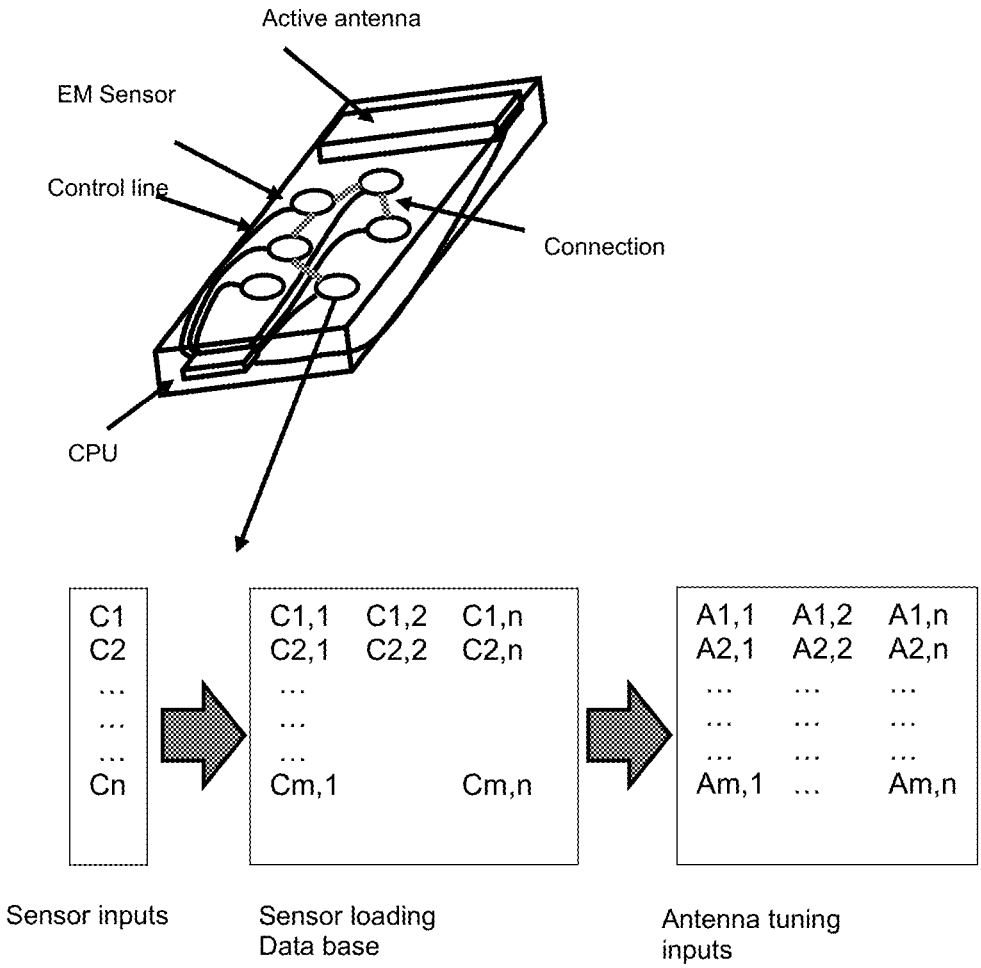
FIG. 6 illustrates lookup tables programmed within a wireless communication device in accordance with embodiments herein, the lookup tables comprise at least sensor loading data and antenna mode data.

FIG. 6 illustrates how measured inputs from the sensors, in this case designated as $C_1$ through $C_n$, are sent to the processor and used to compare to stored sensor loading data, designated as $C_{1,1}$ through $C_{m,n}$. Control signals are then generated and sent to the active antenna for antenna optimization, these control signals designated as $A_{1,1}$ through $A_{m,n}$.

Figure 7:
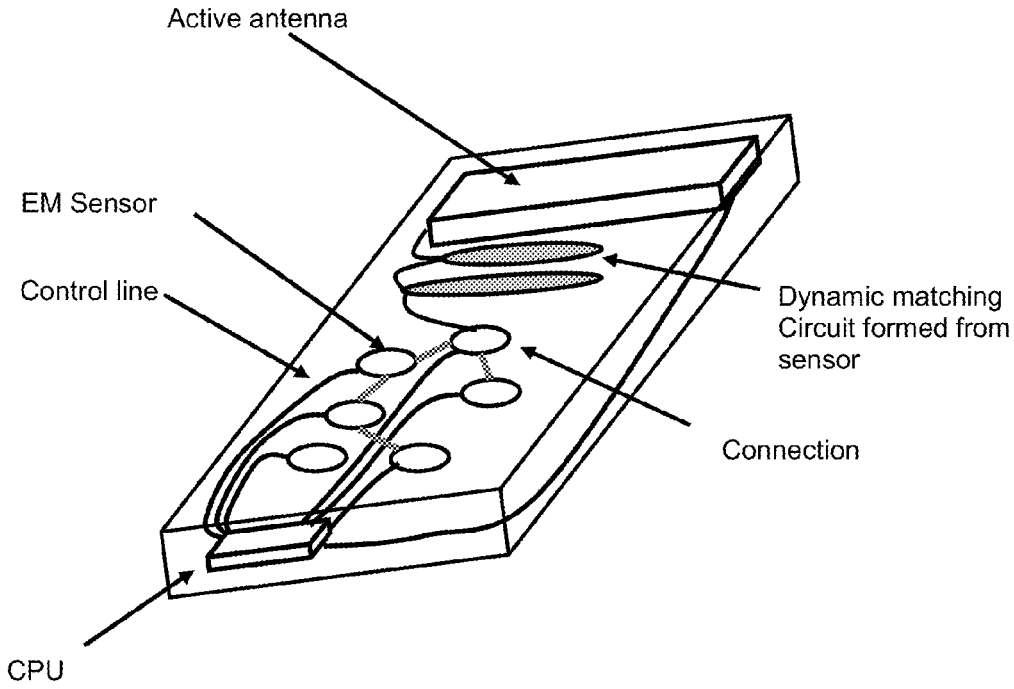
FIG. 7 illustrates a wireless communication device having an active modal antenna and a plurality of sensors each coupled to a processor; wherein an active matching circuit is further provided for active impedance matching of the antenna.

FIG. 7 illustrates sensors positioned in the vicinity of the antenna and integrated into the matching circuit of the antenna. Body loading of the sensors in the matching circuit is used to reactively load the antenna element to provide an improved antenna response for the loaded condition.

Figure 8:
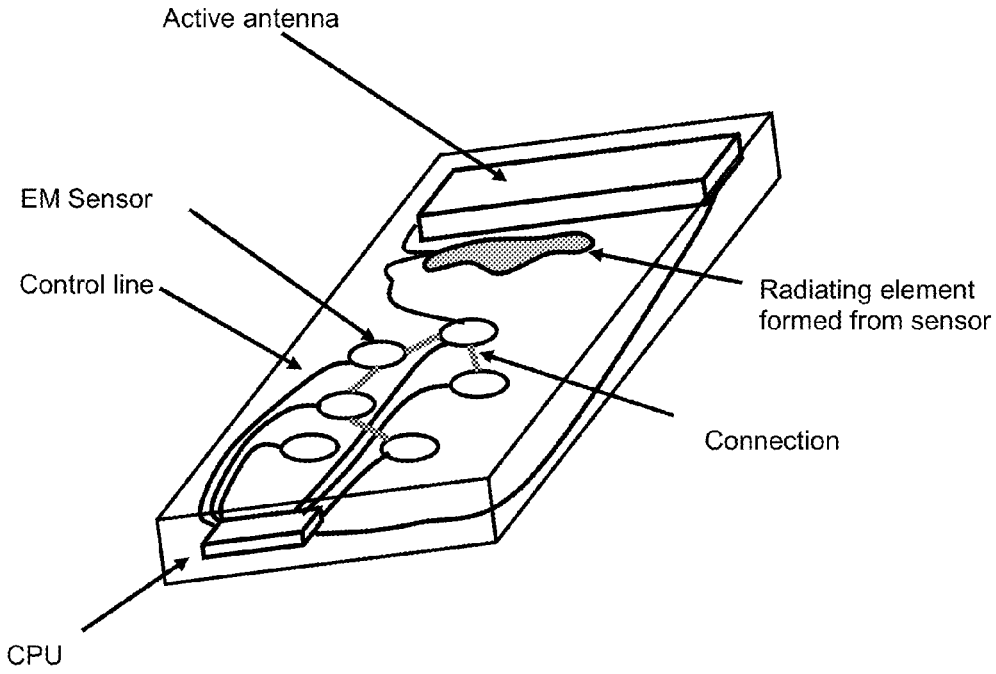
FIG. 8 illustrates a wireless communication device having an active modal antenna and a plurality of sensors each coupled to a processor; wherein a radiating element is formed from a sensor.

FIG. 8 illustrates sensors positioned in the vicinity of the antenna and coupled to the radiating portion of the antenna. These sensors are used as part of the radiating element. The sensors can be coupled to the radiating element in an unloaded or loaded state to improve antenna performance.

Figure 9:
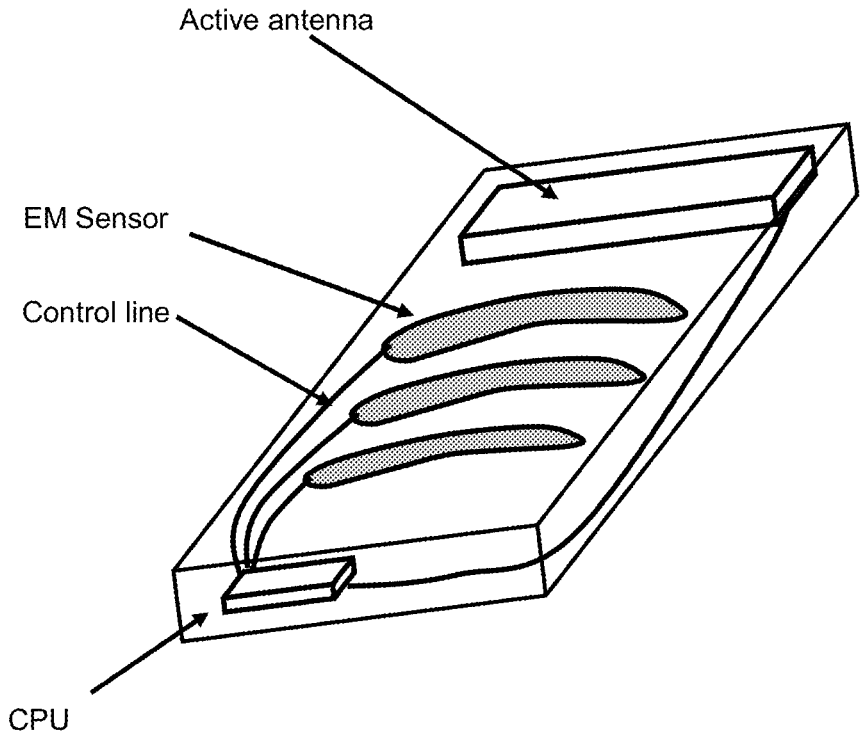
FIG. 9 illustrates sensors disposed on the wireless communication device, the sensors being shaped and positioned for determining grip and positioning of a user's hand.

FIG. 9 illustrates one of multiple sensor configurations that can be integrated into a wireless device for use in sensing environmental changes and conditions. In the configuration shown, sensors are shaped and positioned to take advantage of nominal hand positioning on the wireless device.

Figure 10:
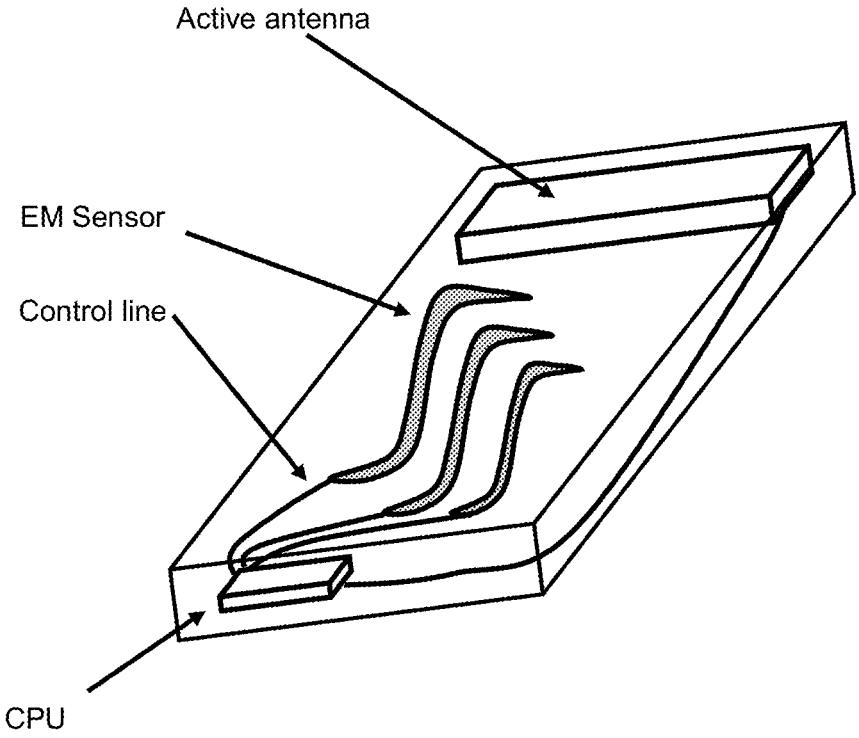
FIG. 10 illustrates sensors disposed on the wireless communication device, the sensors being designed into decorative features or logos.

FIG. 10 illustrates multiple sensors in the shape of a decorative design positioned on the outer surface of an enclosure. Control lines connect the sensors to a processor.

Figure 11:
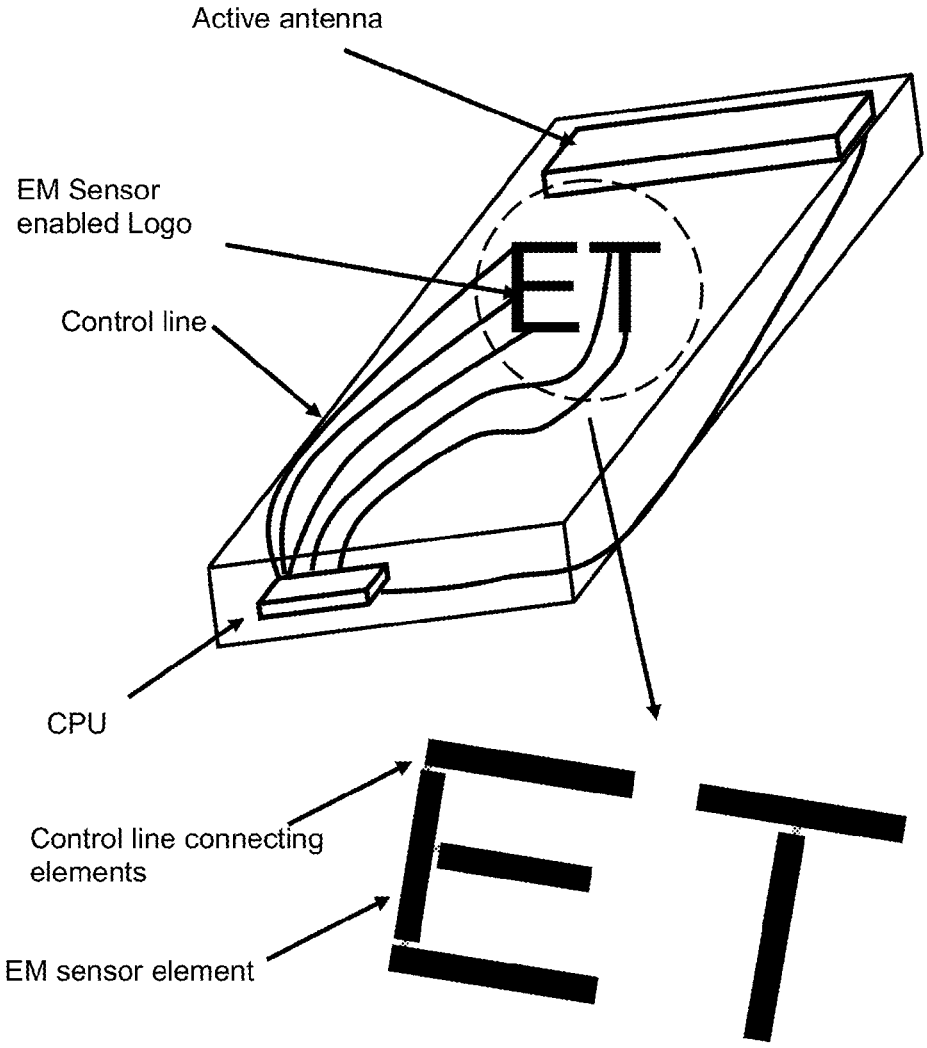
FIG. 11 illustrates an example logo formed from a plurality of sensors dispsosed on a surface of the wireless communication device.

FIG. 11 illustrates a logo which contains two letters, with the logo formed using sensors. Sections of the letters can be formed using sensors, and the individual sensors can be connected to a processor with control lines. The individual sensors can be connected to other sensors to form larger sensors.

Figure 12:
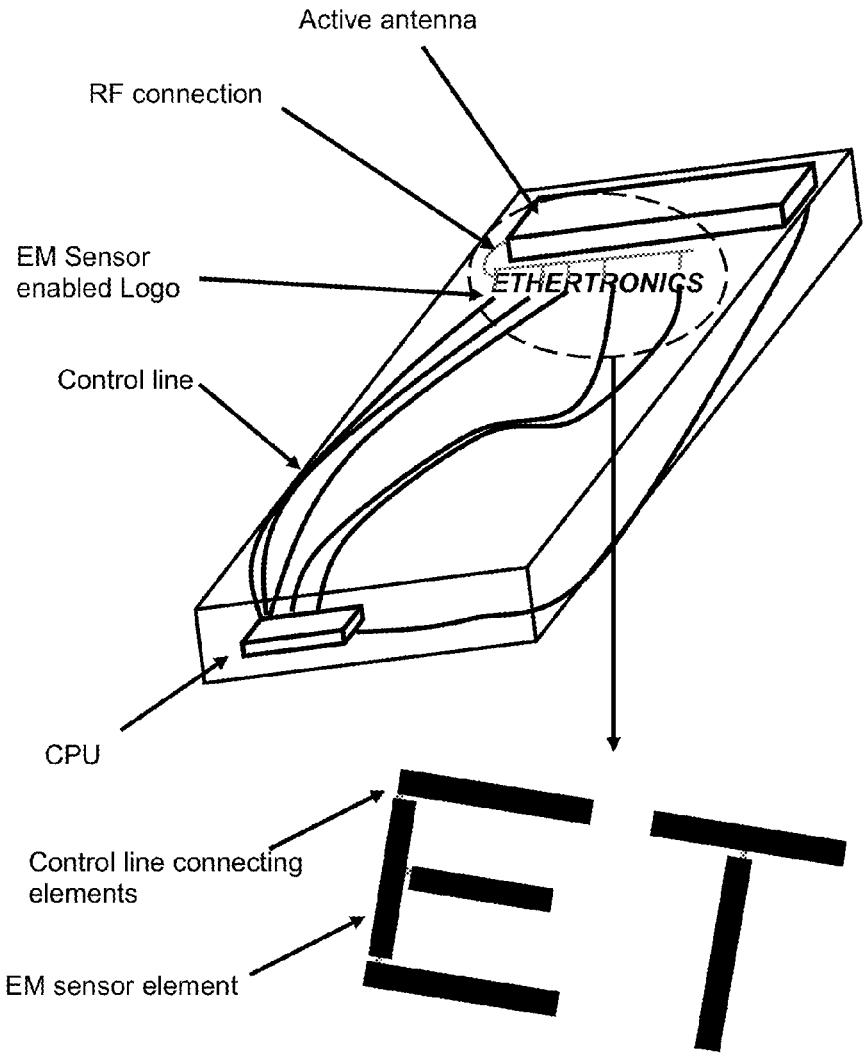
FIG. 12 illustrates the logo formed from a plurality of sensors as illustrated in FIG. 11, wherein the logo formed of sensors is configured to sense a use case for impedance matching the antenna.

FIG. 12 illustrates a logo containing letters, with the logo formed using sensors. Sections of the letters can be formed using sensors, and the individual sensors can be connected to a processor with control lines. The individual sensors can be connected to other sensors to form larger sensors. The sensors are coupled to the antenna matching circuit. Body loading of the sensors in the matching circuit is used to reactively load the antenna element to provide an improved antenna response for the loaded condition.

Figure 13:
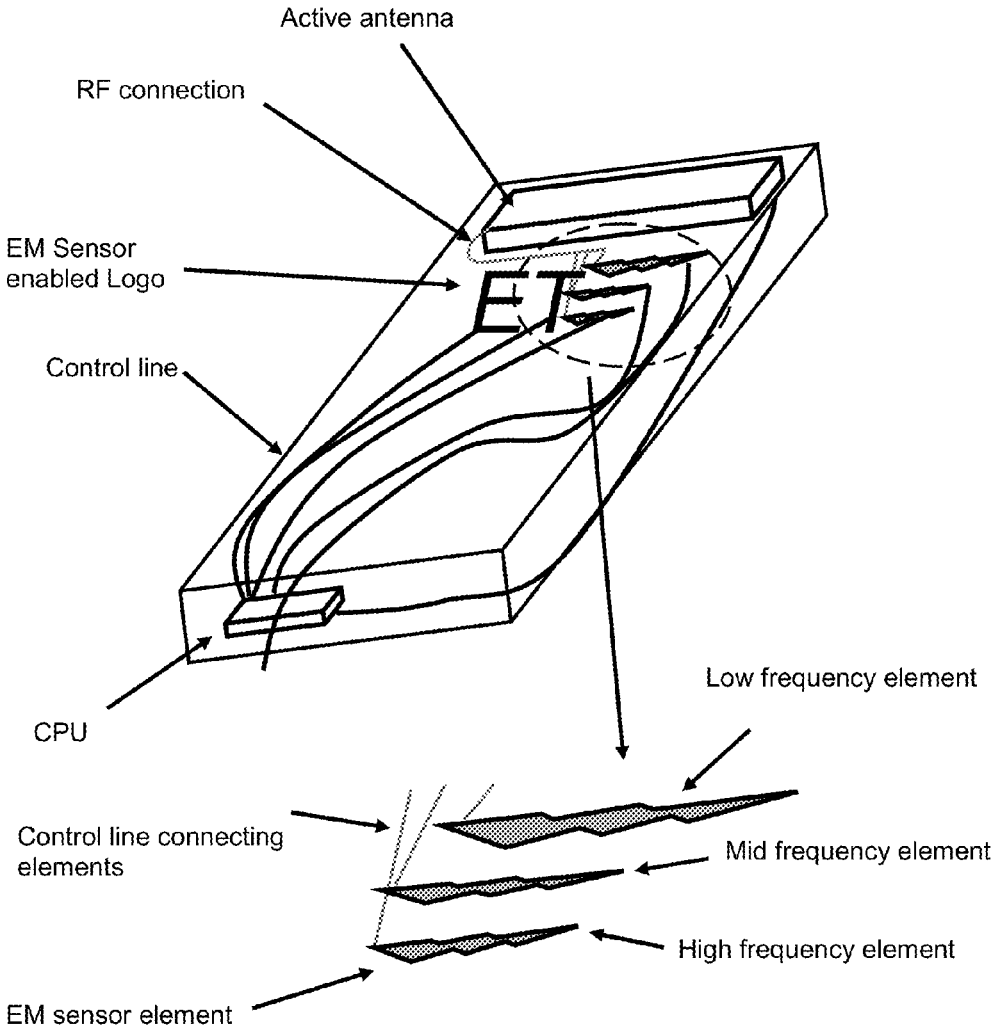
FIG. 13 illustrates an embodiment configured to modify radiating efficiency of the antenna based on loading of logo sensors having various sizes and shapes.

FIG. 13 illustrates a logo containing letters and shapes, with the logo formed using sensors. Sections of the shapes can be formed using sensors, and the individual sensors can be connected to a processor with control lines. The individual sensors can be connected to other sensors to form larger sensors. The sensors are coupled to the antenna radiator. The sensors can be coupled to the radiating element in an unloaded or loaded state to improve antenna performance.

Figure 14:
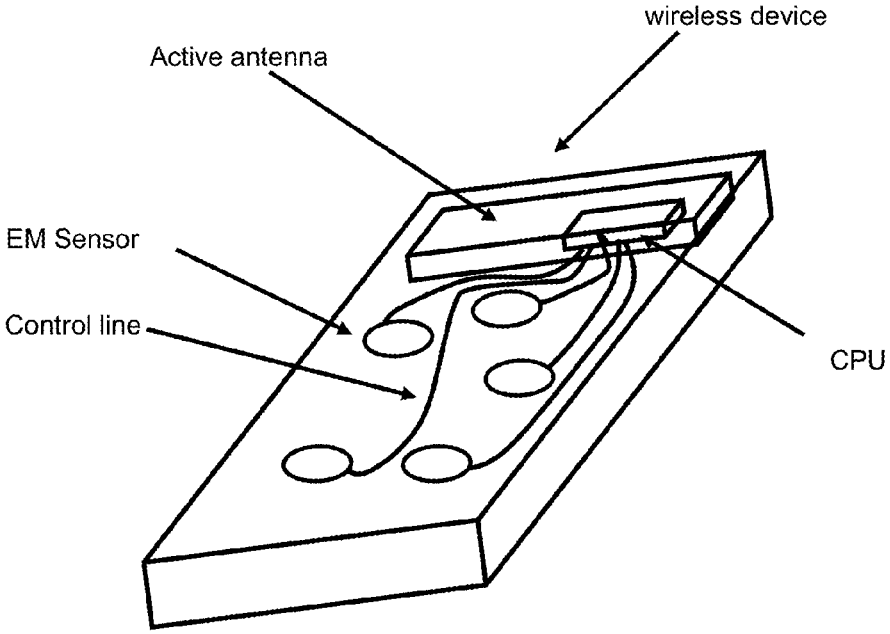
FIG. 14 illustrates an antenna module wherein the processor is contained in the antenna module with the active modal antenna; sensors provide a mechanism for determining an instantaneous use case of the device and a corresponding antenna mode is determined from a lookup table.

FIG. 14 illustrates a wireless device with active antenna and sensors. A microprocessor is integrated in the active antenna and is used to process the signals from the sensors and send tuning signals to the active antenna.

Figure 15:
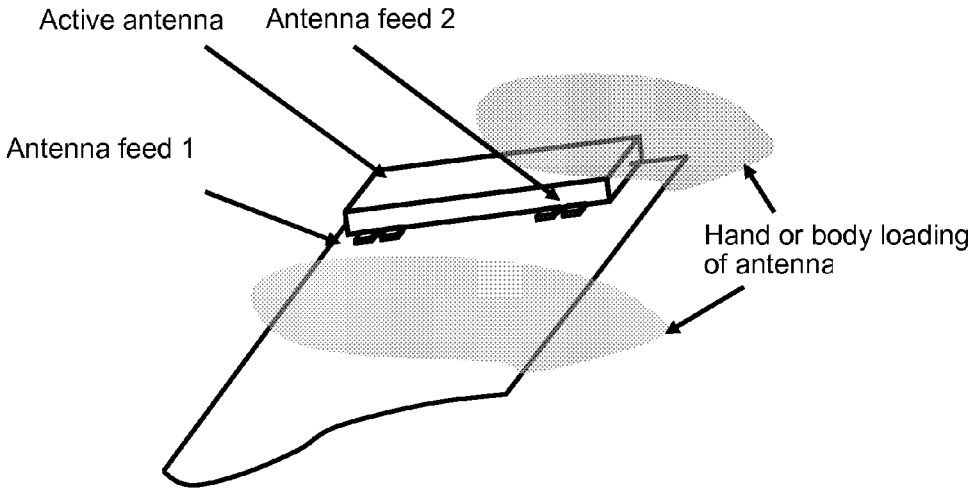
FIG. 15 illustrates an active modal antenna having multiple feeds wherein hand and body loading is sensed an a comparison of antenna performance between feeds is conducted, wherein the best antenna feed is selected based on the loading conditions.
Figure 15:
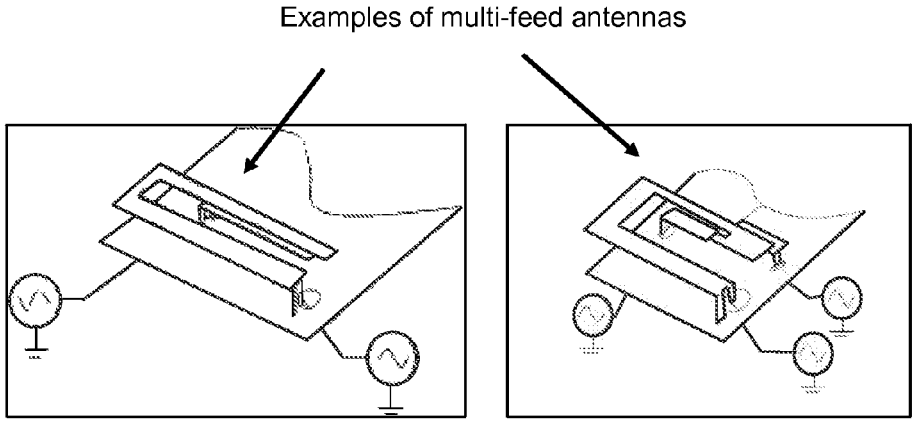

FIG. 15 illustrates a multi-feed active antenna in a wireless device. Hand or body loading of the device can be sensed and a comparison of antenna performance between antenna feeds can be conducted. The best antenna feed is selected according to the loading conditions measured by sensors of the device.

Figure 16:
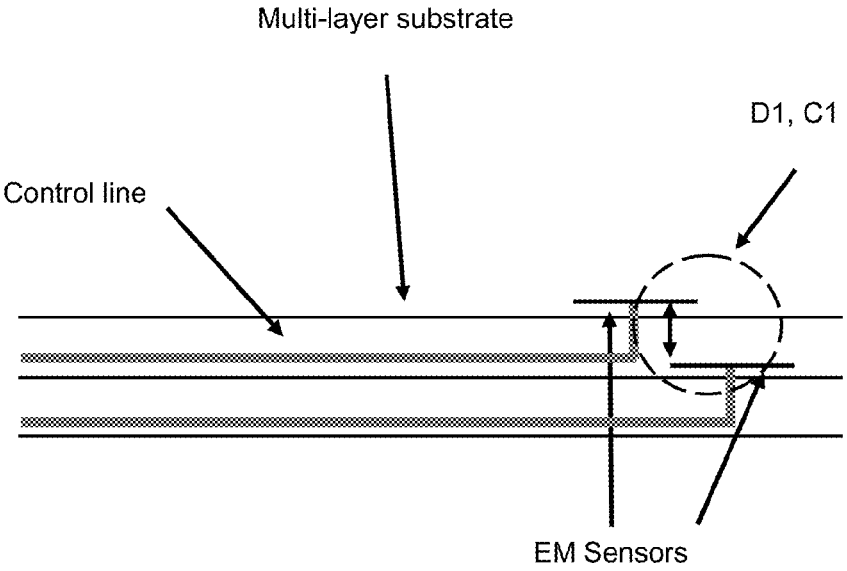
FIG. 16 illustrates a multi-layer sensor configuration, wherein a first sensor is disposed on a first substrate layer and a second sensor is disposed on a second substrate layer above the first substrate layer for providing increased resolution and accuracy of the sensed loading environment or use case.

FIG. 16 illustrates a multi-layer sensor configuration where sensors are displayed in three dimensions. Parameters such as separation distance between sensors or capacitance generated between sensors can be used to sense changes to the local environment. Control lines connect the sensors to a processor. A multi-layer substrate is used to embed the sensor assembly.

Figure 17:
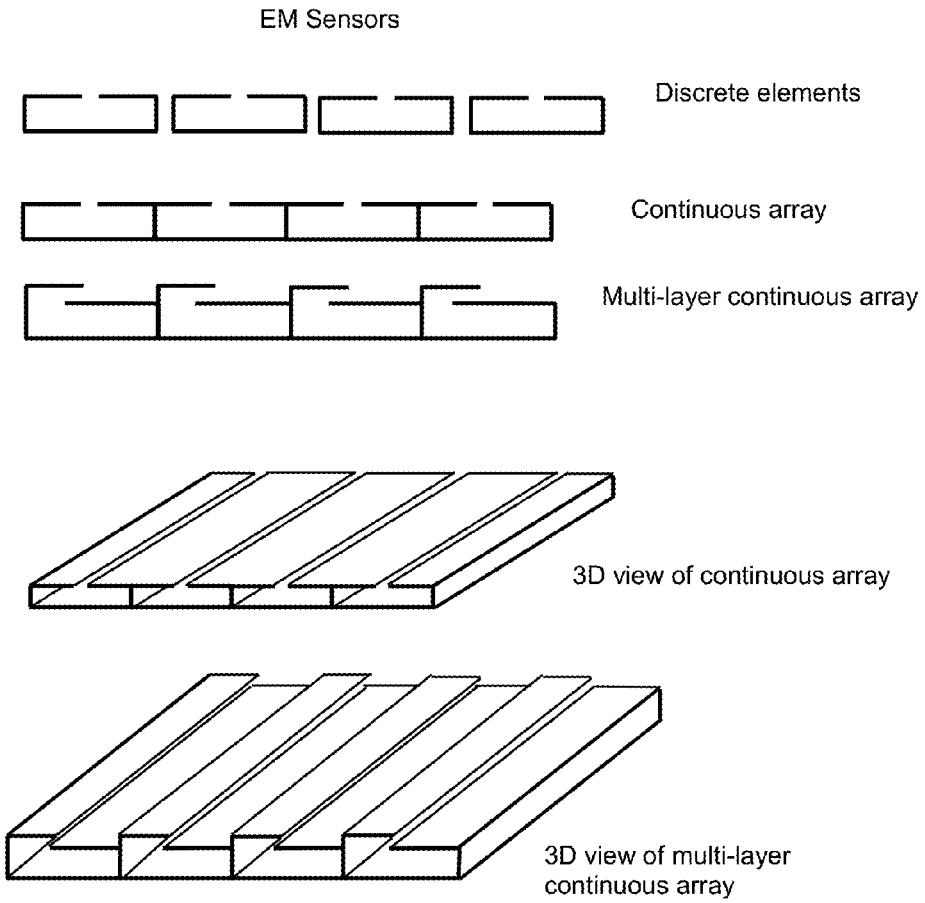
FIG. 17 illustrates isolated magnetic dipole elements in various configurations for use as sensors in the wireless communication device.

FIG. 17 illustrates examples of sensors that can be used to sense environmental changes. Cross section views of the discrete elements, continuous array, and multi-layer continuous array show various configurations of forming resonant structures that can be used to track shifts in resonant frequency, which in turn can be used to estimate device loading or environmental changes. The 3 dimensional views show how these cross sections can be realized into a three dimensional structure to sense loading over a surface.

Although a number of embodiments are illustrated and described above, these representative examples are not intended to limit the spirit and scope of the invention as set forth in the appended claimset. Accordingly, it should be understood by those with skill in the art that a number of variations can be practiced which will yield substantially similar results.

We claim:

1. An antenna system adapted for use with a wireless communication device, comprising:

a first active modal antenna capable of selective operation about a plurality of modes, wherein each of said plurality of modes generates a distinct antenna radiation pattern resulting from the first active modal antenna; and a processor coupled to the active modal antenna;

the first active modal antenna comprising:

a radiating structure disposed above a circuit board and forming an antenna volume therebetween;

a parasitic element positioned adjacent to the radiating structure; and an active element coupled to the parasitic element;

wherein said active element is configured for one or more of: adjusting a reactance of the parasitic element, or shorting the parasitic element to ground;

the processor adapted to be further coupled to a plurality of sensors disposed about the wireless communication device, wherein the plurality of sensors are configured to determine a present use case of a plurality of possible use cases of the device; and the processor being configured to access a lookup table containing data relating each of the plurality of possible use cases with a corresponding antenna mode of the plurality of modes for achieving optimum antenna performance;

wherein the antenna system is configured to determine the present use case of the device using the sensors, lookup the corresponding antenna mode associated with the present use case of the device for achieving optimum antenna performance, and configure the active modal antenna to function in the corresponding antenna mode.

2. The antenna system of claim 1, wherein the processor is a baseband processor residing within the wireless communication device.

3. The antenna system of claim 1, wherein the processor is an applications processor.

4. The antenna system of claim 1, wherein the active modal antenna is configured for one or more of: beam steering, band switching, and active impedance matching.

5. The antenna system of claim 1, wherein the sensors comprise capacitive proximity sensors.

6. The antenna system of claim 5, wherein one or more of the sensors are shaped and positioned about the wireless communication device to conform to fingers of a user when holding the device.

7. The antenna system of claim 5, wherein one or more of the sensors are configured in the shape of a logo.

8. The antenna system of claim 5, wherein the sensors are disposed about a first substrate layer and a second substrate layer positioned above the first substrate layer for multi-layer sensing and providing increased resolution and accuracy in determining the present use case.

9. The antenna system of claim 5, wherein the sensors comprise discrete sensor elements positioned about the wireless communication device.

10. The antenna system of claim 5, wherein the sensors comprise a continuous array of sensor elements positioned about the wireless communication device.

11. The antenna system of claim 5, wherein the sensors comprise a multi-layer continuous array of sensor elements positioned about the wireless communication device.

12. The antenna system of claim 5, wherein one or more of the sensors comprise an isolated magnetic dipole element.

13. The antenna system of claim 1, further comprising an active matching circuit coupled to the active modal antenna and the processor, the active matching circuit comprising one or more active elements and configured to vary a reactance of the antenna based on the present use case and the data stored within the lookup table.

14. An antenna system adapted for integration with a wireless communication device, comprising:

an active modal antenna capable of selective operation about a plurality of modes, wherein each of said plurality of modes generates a distinct antenna radiation pattern resulting from the first active modal antenna;

a processor coupled to the active modal antenna; and an active matching circuit coupled to the active modal antenna and the processor, the active matching circuit adapted to vary a reactance of the antenna;

the active modal antenna comprising:

a radiating structure disposed above a circuit board and forming an antenna volume therebetween;

a parasitic element positioned adjacent to the radiating structure; and an active element coupled to the parasitic element;

wherein said active element is configured for one or more of: adjusting a reactance of the parasitic element, or shorting the parasitic element to ground;

the processor adapted to be further coupled to a plurality of sensors disposed about the wireless communication device, wherein the plurality of sensors are configured to determine a present use case from a plurality of possible use cases of the device;

the processor being configured to access a lookup table containing data relating each of the plurality of possible use cases with a corresponding antenna mode of the plurality of modes for achieving optimum antenna performance;

wherein the antenna system is configured to determine the present use case of the device using the sensors, lookup the corresponding antenna mode for achieving optimum antenna performance with the device in the present use case, and configure the active modal antenna to function in the corresponding antenna mode; and wherein the antenna system is further configured to communicate control signals from the processor to the active matching circuit for dynamically matching the impedance of the antenna.

15. An antenna system adapted for use with a wireless communication device, comprising:

an active modal antenna capable of selective operation about a plurality of modes, wherein each of said plurality of modes generates a distinct antenna radiation pattern resulting from the active modal antenna; and a processor coupled to the active modal antenna;

the active modal antenna consisting of a single antenna radiator being configured to radiate a distinct pattern at each of the plurality of modes;

the processor adapted to be further coupled to a plurality of sensors disposed about the wireless communication device, wherein the plurality of sensors are configured to determine a present use case of a plurality of possible use cases of the device; and the processor being configured to access a lookup table containing data relating each of the plurality of possible use cases with an associated antenna mode for achieving optimum antenna performance when in the respective use case;

wherein the antenna system is configured to determine the present use case of the device using the sensors, lookup the corresponding antenna mode associated with the present use case of the device for achieving optimum antenna performance, and configure the active modal antenna to function in the corresponding antenna mode.

* * * * *